US010421304B2

(12) United States Patent
Kita et al.

(10) Patent No.: US 10,421,304 B2
(45) Date of Patent: Sep. 24, 2019

(54) PRINTER

(71) Applicant: Brother Kogyo Kabushiki Kaisha, Nagoya-shi, Aichi-ken (JP)

(72) Inventors: Hiroaki Kita, Nagoya (JP); Yusuke Ikemoto, Nagoya (JP); Ryuichi Kanda, Nagoya (JP); Yuichiro Suzuki, Komaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 211 days.

(21) Appl. No.: 15/720,035

(22) Filed: Sep. 29, 2017

(65) Prior Publication Data

US 2018/0222232 A1 Aug. 9, 2018

(30) Foreign Application Priority Data

Feb. 8, 2017 (JP) ..... 2017-021176

(51) Int. Cl.

| | |
|---|---|
| ***B41J 29/54*** | (2006.01) |
| ***B41J 29/13*** | (2006.01) |
| ***B41J 15/04*** | (2006.01) |
| ***B65H 16/06*** | (2006.01) |

(Continued)

(52) U.S. Cl.

CPC ..... *B41J 29/54* (2013.01); *B41J 11/057* (2013.01); *B41J 15/04* (2013.01); *B41J 15/042* (2013.01); *B41J 29/13* (2013.01); *B65H 16/06* (2013.01); *B41J 11/14* (2013.01); *B41J 2202/31* (2013.01); *B65H 2301/41346* (2013.01); *B65H 2402/41* (2013.01); *B65H 2511/12* (2013.01); *B65H 2801/03* (2013.01)

(58) Field of Classification Search

CPC . B41J 29/52; B41J 29/13; B41J 11/057; B41J 11/14; B41J 15/04; B41J 15/042; B41J 2202/31; B41J 11/58; B41J 11/045; B65H 16/06; B65H 2301/41346; B65H 2402/41; B65H 2511/12; B65H 2801/03

See application file for complete search history.

(56) References Cited

U.S. PATENT DOCUMENTS

| | | | |
|---|---|---|---|
| 8,342,763 | B2 | 1/2013 | Vo et al. |
| 9,290,026 | B2 | 3/2016 | Nagashima et al. |

(Continued)

FOREIGN PATENT DOCUMENTS

| | | | |
|---|---|---|---|
| CN | 203580359 | U | 5/2014 |
| JP | 2015-160424 | A | 9/2015 |

*Primary Examiner* — David H Banh

(74) *Attorney, Agent, or Firm* — Banner & Witcoff, Ltd.

(57) ABSTRACT

A printer includes two supporters disposed at a storage section, an adjuster movably supporting at least a specific supporter of the two supporters, a protrusion protruding upward from a second section, the second section being an upper portion of the specific supporter, a locking section locking a first section in a position to which the first section is moved via the adjuster, the first section being a lower portion of the specific supporter, and an engagement section having elastically-deformable engagement pieces arranged at intervals in a particular direction intersecting a vertical direction, the protrusion being configured to, when the cover is closed, engage with at least a specific engagement piece from beneath, the specific engagement piece being maintained elastically deformed upward.

7 Claims, 8 Drawing Sheets

(51) Int. Cl.
*B41J 11/057* (2006.01)
*B41J 11/14* (2006.01)

(56) References Cited

U.S. PATENT DOCUMENTS

2002/0175985 A1* 11/2002 Zevin ..... B41J 15/02
347/104
2010/0061790 A1* 3/2010 Yu ..... B41J 3/4075
400/613
2011/0309570 A1* 12/2011 Uchino ..... B65H 3/44
271/253
2014/0255075 A1* 9/2014 Ohnishi ..... B41J 15/042
400/613
2014/0375738 A1* 12/2014 Nagashima ..... B41J 15/042
347/104
2015/0225198 A1* 8/2015 Sakaino ..... B41J 11/0025
242/566
2015/0246568 A1 9/2015 Nagashima et al.
2018/0297380 A1* 10/2018 Ikemoto ..... B41J 15/042

* cited by examiner

PRINTER

CROSS-REFERENCE TO RELATED APPLICATION

This application claims priority under 35 U.S.C. § 119 from Japanese Patent Application No. 2017-021176 filed on Feb. 8, 2017. The entire subject matter of the application is incorporated herein by reference.

BACKGROUND

Technical Field

The following description relates to aspects of a printer.

Related Art

Heretofore, a printer has been known that is configured to accommodate a roll that is a print medium wound in a roll shape. The known printer includes a pair of supporters and a regulator. Each of the supporters supports a corresponding one of both side surfaces of the roll. The supporters are configured to move along a width direction of the roll, thereby adjusting a distance therebetween in accordance with a width of the roll. The regulator is configured to lock the supporters, thereby holding positions of the supporters after adjustment of the distance between the supporters.

SUMMARY

A user may carry the known printer with him (her) to use the printer in his (her) desired place. In this case, if the user mistakenly drops the printer from a certain height, the supporters supporting the roll might be damaged due to an impact caused by the drop, depending on how high the certain height is.

Aspects of the present disclosure are advantageous to provide one or more improved techniques, for a printer, which make it possible to prevent supporters that support a roll from being damaged, even when the supporters receive an impact caused, e.g., when the printer is dropped.

According to aspects of the present disclosure, a printer is provided that includes a main body including a storage section configured to accommodate a roll, the roll being a print medium wound in a roll shape, the storage section being open toward a first side in a second direction intersecting a first direction, the first direction being an axis direction of the roll, the first side being a particular one of both sides of the printer in the second direction, a cover openable and closable relative to the storage section, the cover being configured to, when closed, cover the storage section from the first side in the second direction, two supporters disposed at the storage section, the two supporters being configured to support the roll from both sides of the roll in the first direction, an adjuster configured to support at least a specific supporter of the two supporters in such a manner that the specific supporter is movable along the first direction, and to adjust a distance between the two supporters in the first direction in accordance with movement of the specific supporter along the first direction, a locking section configured to lock a first section in a position to which the first section is placed when the specific supporter is moved via the adjuster, the first section being a second-side portion of the specific supporter in the second direction, the second side being opposite to the first side in the second direction, a protrusion that protrudes toward the first side in the second direction from a second section, the second section being a first-side portion of the specific supporter in the second direction, and an engagement section disposed at the cover, the engagement section including a plurality of engagement pieces arranged with a gap between each two of mutually-adjacent engagement pieces in the first direction, each engagement piece being elastically deformable toward the first side in the second direction. The protrusion is configured to, when the cover is closed, engage with at least a first engagement piece of the engagement pieces from the second side in the second direction, the first engagement piece being maintained elastically deformed toward the first side in the second direction. The protrusion is further configured to, when a first external force toward a third side in the first direction is applied to the specific supporter, come into contact with a second engagement piece from a fourth side in the first direction due to flection of the specific supporter, the protrusion being restricted from moving toward the third side in the first direction, due to the contact with the second engagement piece, the third side being a particular one of both sides of the printer in the first direction, the fourth side being opposite to the third side in the first direction, the second engagement piece being a particular one of the engagement pieces that is adjacent to a third-side end of the first engagement piece in the first direction.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an illustrative embodiment according to aspects of the present disclosure will be described with reference to the accompanying drawings. A printer 1 is connectable with an external terminal device (not shown) via a USB cable ("USB" is a trademark registered). The printer 1 is configured to print, on a print medium, an image including characters and graphics based on print data received from the external terminal device. For instance, the print medium is a thermosensitive label. For instance, the external terminal device is a general-purpose personal computer (hereinafter referred to as a "PC"). The printer 1 is further configured to be driven by a battery. For instance, when attached to a waist belt via a belt clip (not shown), the printer 1 is used while being carried by a user. It is noted that in the following description, a lower right side, an upper left side, an upper right side, a lower left side, an upper side, and a lower side in FIG. 1 will be defined as a right side, a left side, a rear side, a front side, an upper side, and a lower side of the printer 1.

Figure 1:
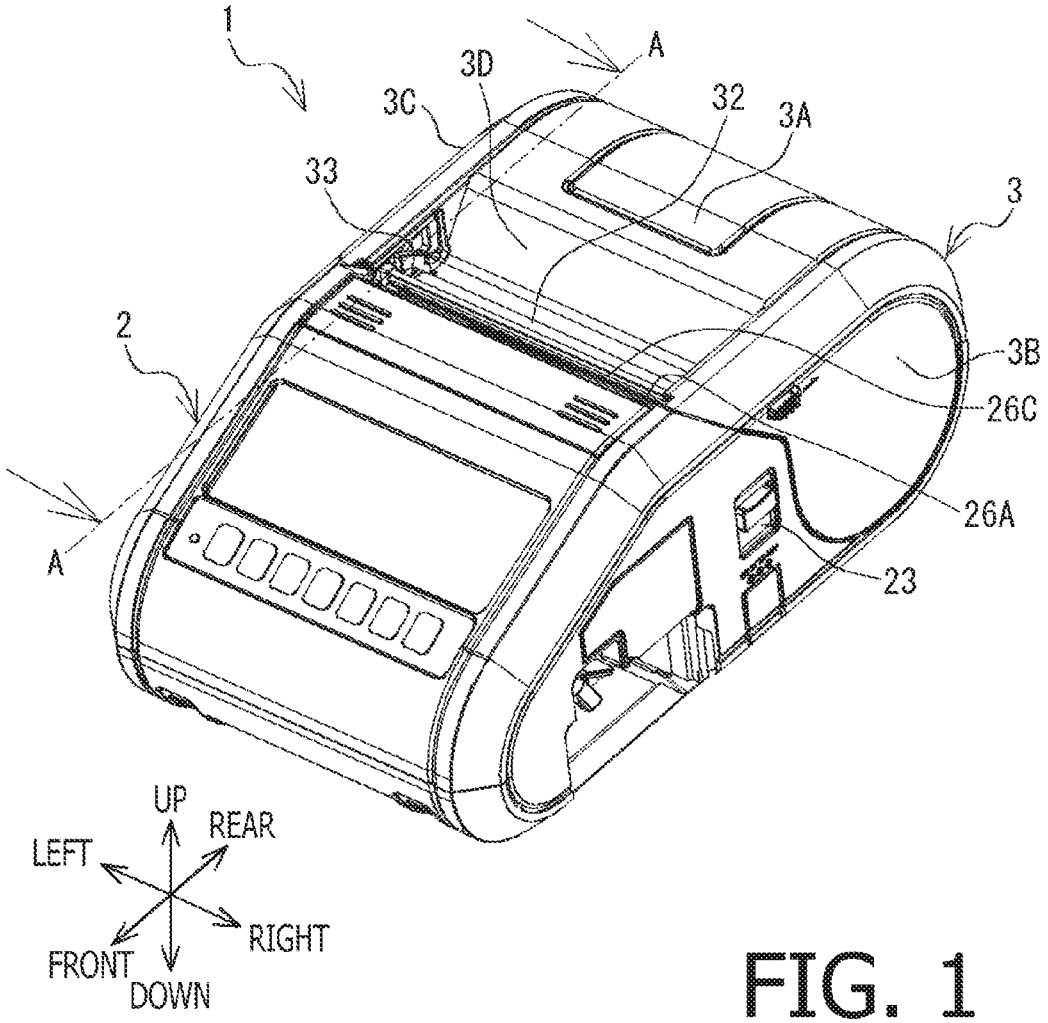
FIG. 1 is a perspective view showing a printer in a state where a cover is in a closed position, in an illustrative embodiment according to one or more aspects of the present disclosure.

A general overview of the printer 1 will be described with reference to FIGS. 1 to 4. As shown in FIG. 1, the printer 1 includes a main body 2 and a cover 3. The main body 2 is formed substantially in a rectangular parallelepiped box shape. A lever 23 is disposed at a right side surface of the main body 2. The lever 23 is configured to be operated up and down by the user.

Figure 2:
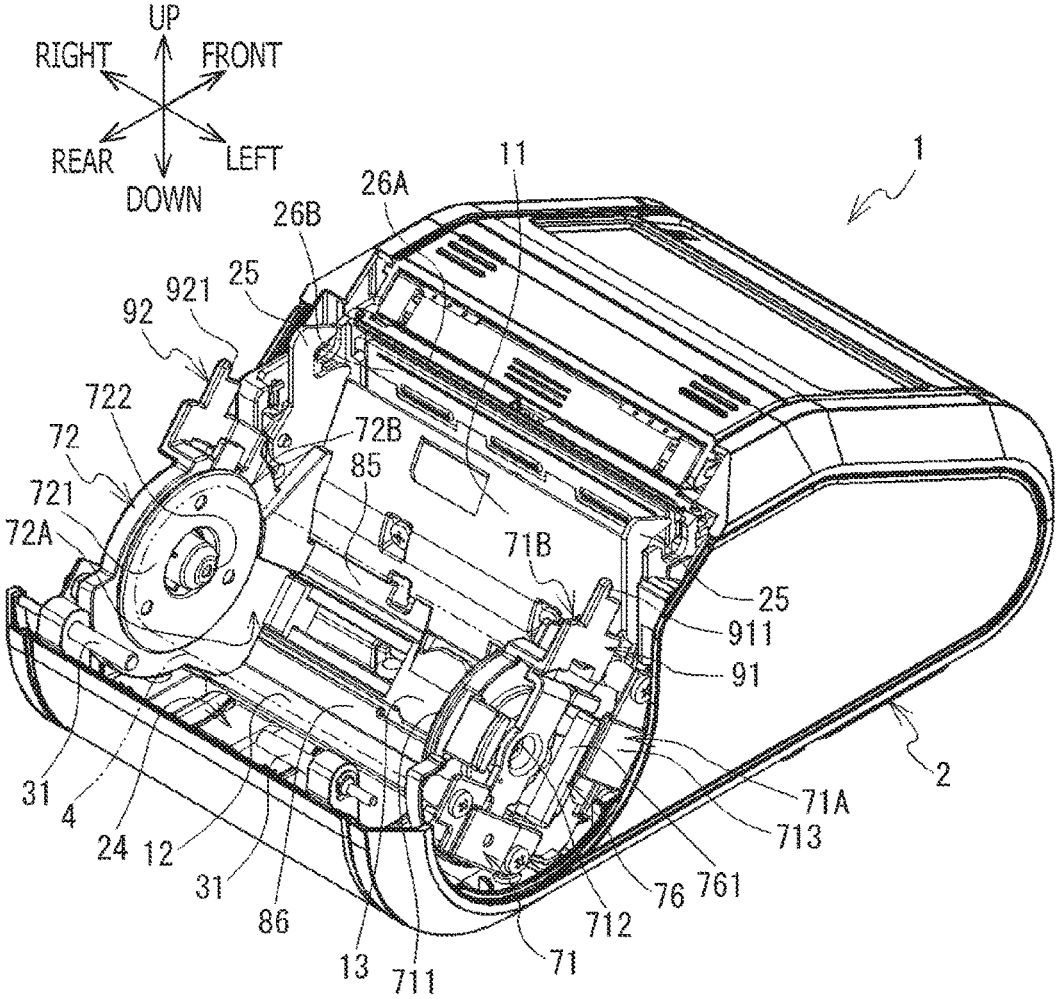
FIG. 2 is a perspective view showing the printer from which the cover is removed, in the illustrative embodiment according to one or more aspects of the present disclosure.

As shown in FIG. 2, a storage section 24 is disposed at a rear half portion of an inside of the min body 2. The storage section 24 is open in upward, leftward, and rightward directions. In the storage section 24, a roll 4 is stored. The roll 4 is formed by a mount (hereinafter referred to as a "tape") with a thermosensitive label attached thereon being wound around a cylindrical core body. In the storage section 24, a holder 10 is fixedly attached. The holder 10 is configured to hold the roll 4. A cutting blade 26A is disposed at an upper portion of a front wall of the storage section 24. The cutting blade 26A is configured to cut off a printed portion of the tape. A thermal head 26B is disposed under the cutting blade 26A. The thermal head 26B is configured to thermally print characters on the thermosensitive label. Each of the cutting blade 26A and the thermal head 26B extends along a left-to-right direction. Lock sections 25 protrude rearward from a left end portion and a right end portion of the upper end portion of the front wall of the storage section 24, respectively. A lower end portion of each lock section 25 is swingably supported by a shaft (not shown). When the lever 23 is pushed down, an upper end portion of each lock section 25 swings rearward.

As shown in FIG. 1, the cover 3 is configured to be open and closed relative to the storage section 24. The following description will be provided on the basis of a state (see FIG. 1) where the cover 3 is closed relative to the storage section 24. The cover 3 includes an upper cover 3A, a right cover 3B, and a left cover 3C. The upper cover 3A extends substantially orthogonally to the vertical direction, behind the cutting blade 26A (i.e., on a rear side of the cutting blade 26A). An inclined wall 3D is formed at a front end portion of the upper cover 3A. The inclined wall 3D is inclined to extend obliquely toward a lower front side. The right cover 3B extends downward from a right end portion of the upper cover 3A. The left cover 3C extends downward from a left end portion of the upper cover 3A. A rear end portion of the upper cover 3A is rotatably supported by two shafts 31 (see FIG. 2). Each of the two shafts 31 extends along the left-to-right direction. The two shafts 31 are disposed at an upper part of the rear end portion of the storage section 24.

The cover 3 is swingable around the two shafts 31 between a closed position (see FIG. 1) and an open position (not shown). When in the closed position, the cover 3 overs an opening of the storage section 24 (see FIG. 2) from above and from both sides in the left-to-right direction. Specifically, when the cover 3 is in the closed position, the upper cover 3A covers an upper opening of the storage section 24 from above, the right cover 3B covers a right opening of the storage section 24 from the right, and the left cover 3C covers a left opening of the storage section 24 from the left. When in the open position, the cover 3 opens the opening of the storage section 24. The cover 3 is urged by an urging member (not shown) in such a direction as to swing from the closed position to the open position. In other words, the cover 3 is urged clockwise in a right side view (i.e., when viewed from the right).

Figure 3:
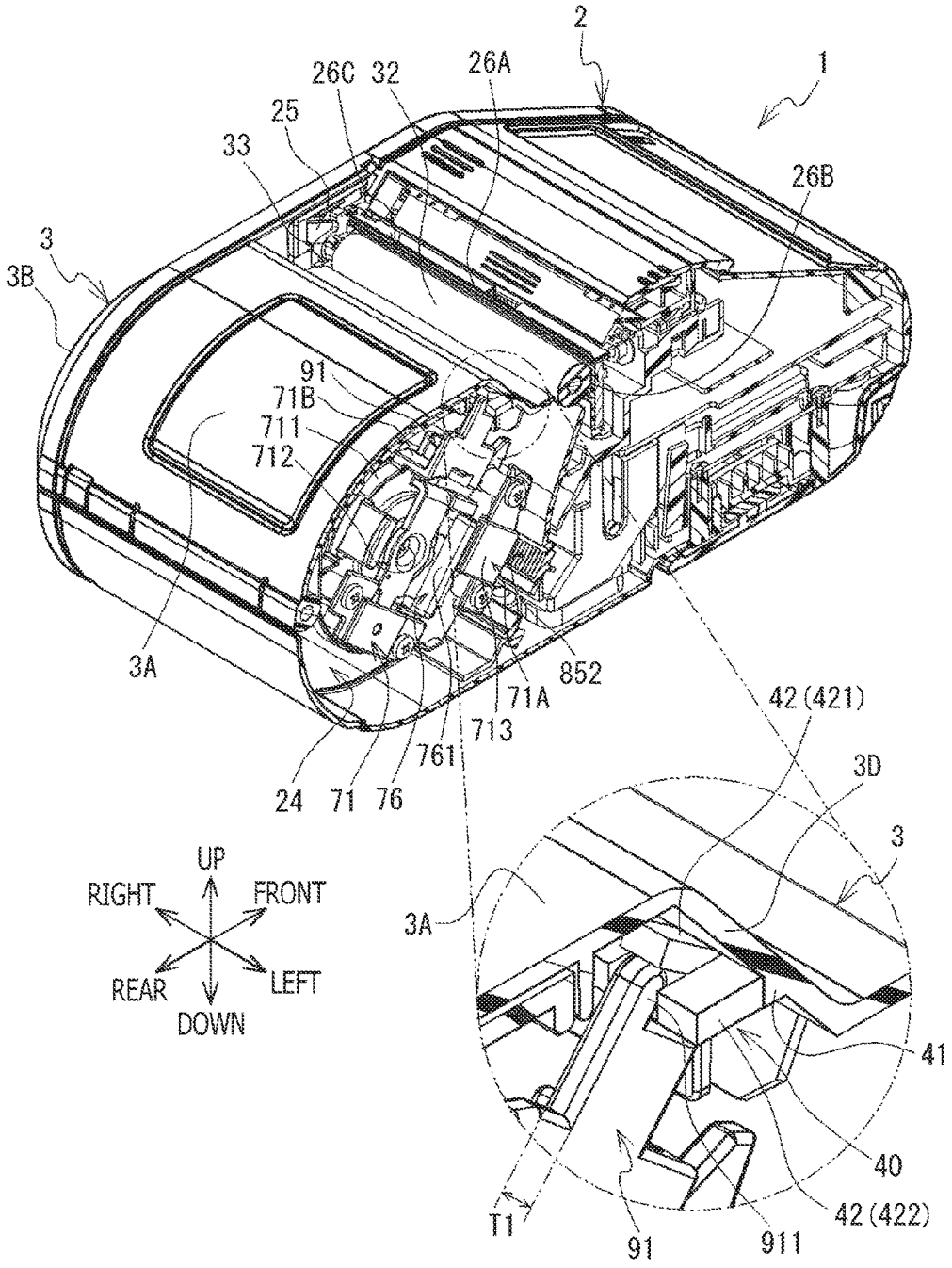
FIG. 3 is a cross-sectional perspective view when a cross section taken along a line A-A is viewed in a direction of an arrow in FIG. 1, in the illustrative embodiment according to one or more aspects of the present disclosure.

As shown in FIG. 3, at the front end portion of the cover 3, a platen roller 32 is rotatably supported. A rotational shaft of the platen roller 32 extends along the left-to-right direction. The rotational shaft of the platen roller 32 has extensions 33. Specifically, a left extension 33 extends outward from a left end portion of the rotational shaft of the platen roller 32. A right extension 33 extends outward from a right end portion of the rotational shaft of the platen roller 32. When the cover 3 is in the closed position, each of the lock sections 25 engages with a corresponding one of the extensions 33. In this case, the cover 3 is held in the closed position. In response to the lever 23 (see FIG. 1) being pushed down when the cover 3 is in the closed position, each of the lock sections 25 disengages from a corresponding one of the extensions 33. Then, the cover 3 is swung around the two shafts 31 (see FIG. 2) to the open position by an urging force from the urging member.

When the cover 3 is in the closed position, the thermal head 26B and the platen roller 32 are in proximity to each other. When the tape is placed between the thermal head 26B and the platen roller 32, the platen roller 32 presses the tape against the thermal head 26B. When driven by a motor (not shown), the platen roller 32 rotates. Thereby, the platen roller 32 conveys the tape while pressing the tape against the thermal head 26B. When the cover 3 is in the closed position, a discharge port 26C is formed between the cutting blade 26A and the platen roller 32. Through the discharge port 26C, the tape printed inside the printer 1 is discharged out of the printer 1.

Figure 4:
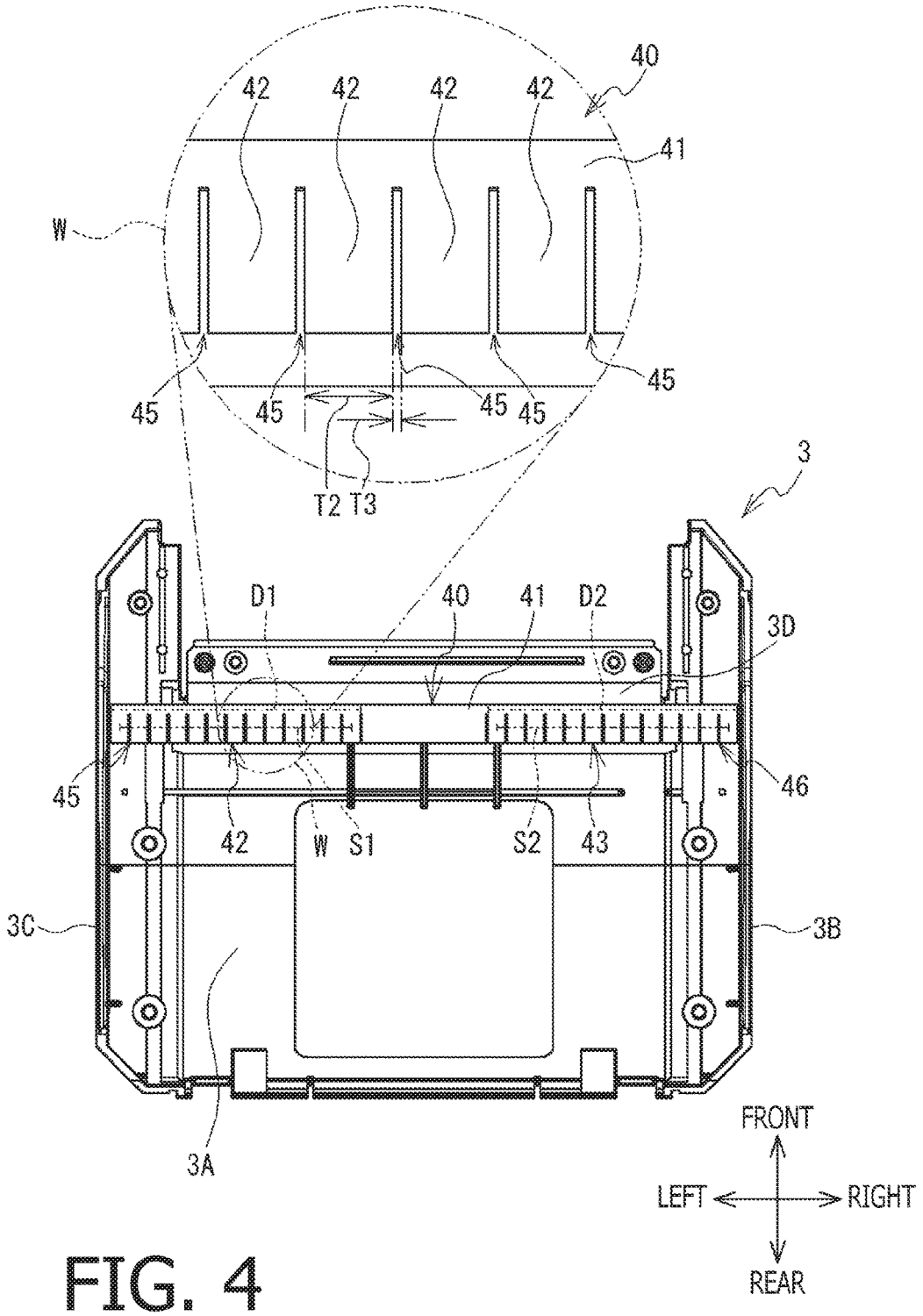
FIG. 4 is a bottom view of the cover in the illustrative embodiment according to one or more aspects of the present disclosure.

As shown in FIG. 4, an engagement section 40 is disposed at a portion, near and behind the platen roller 32 (see FIG. 3), of a lower surface of the cover 3. The engagement section 40 extends from the right cover 3B to the left cover 3C along the left-to-right direction. A front end portion (hereinafter referred to as a "connection part 41") of the engagement section 40 is connected with a lower surface of the inclined wall 3D. In the illustrative embodiment, the engagement section 40 is formed integrally with the cover 3. The engagement section 40 includes a plurality of left engagement pieces 42 and a plurality of right engagement pieces 43. Each of the left engagement pieces 42 and the right engagement pieces 43 protrudes rearward from the connection part 41. As described above, the inclined wall 3D is inclined to extend obliquely toward a lower front side. Therefore, above each of the engagement pieces 42 and 43, there is a space formed between the cover 3 and each of the engagement pieces 42 and 43 (see FIG. 3). Each of the engagement pieces 42 and 43 is elastically deformable upward, leftward, and rightward.

The plurality of left engagement pieces 42 are disposed at a left portion of the engagement section 40 with respect to a center of the engagement section 40 in the left-to-right direction. A range D1 over which the plurality of left engagement pieces 42 are disposed includes a movable range S1 of a below-mentioned protrusion 91 (see FIG. 2) in the left-to-right direction. The plurality of left engagement pieces 42 are arranged at intervals in the left-to-right direction. A slit 45 is formed between each two of mutually-adjacent left engagement pieces 42 in the left-to-right direction. The plurality of right engagement pieces 43 are disposed at a right portion of the engagement section 40 with respect to the center of the engagement section 40 in the left-to-right direction. A range D2 in which the plurality of right engagement pieces 43 are disposed includes a movable range S2 of a below-mentioned protrusion 92 (see FIG. 2) in the left-to-right direction. The plurality of right engagement pieces 43 are arranged at intervals in the left-to-right direction. A slit 46 is formed between each two of mutually-adjacent right engagement pieces 43 in the left-to-right direction.

The engagement section 40 is formed bilaterally symmetric in the left-to-right direction. Namely, the plurality of right engagement pieces 43 and the plurality of slits 46 correspond to the plurality of left engagement pieces 42 and the plurality of slits 45, respectively. In the following description, explanations will be provided about shapes of the plurality of left engagement pieces 42 and the plurality of slits 45 will be described. Meanwhile, explanations about shapes of the plurality of right engagement pieces 43 and the plurality of slits 46 will be omitted. Each of the left engagement pieces 42 is formed in a rectangular shape in a plane view (i.e., when viewed from the top). Further, the left engagement pieces 42 have the same outer shape and the same size. Namely, the left engagement pieces 42 have a same length T2 in the left-to-right direction. Each of the slits 45 is open rearward. Each of the slits 45 is recessed frontward in a rectangular shape in the plane view. Every slit 45 has the same outer shape and the same size. Namely, every slit 45 has a uniform width in the left-to-right direction. In other words, a distance (gap) T3 between each two of mutually-adjacent left engagement pieces 42 in the left-to-right direction is uniform.

Figure 5:
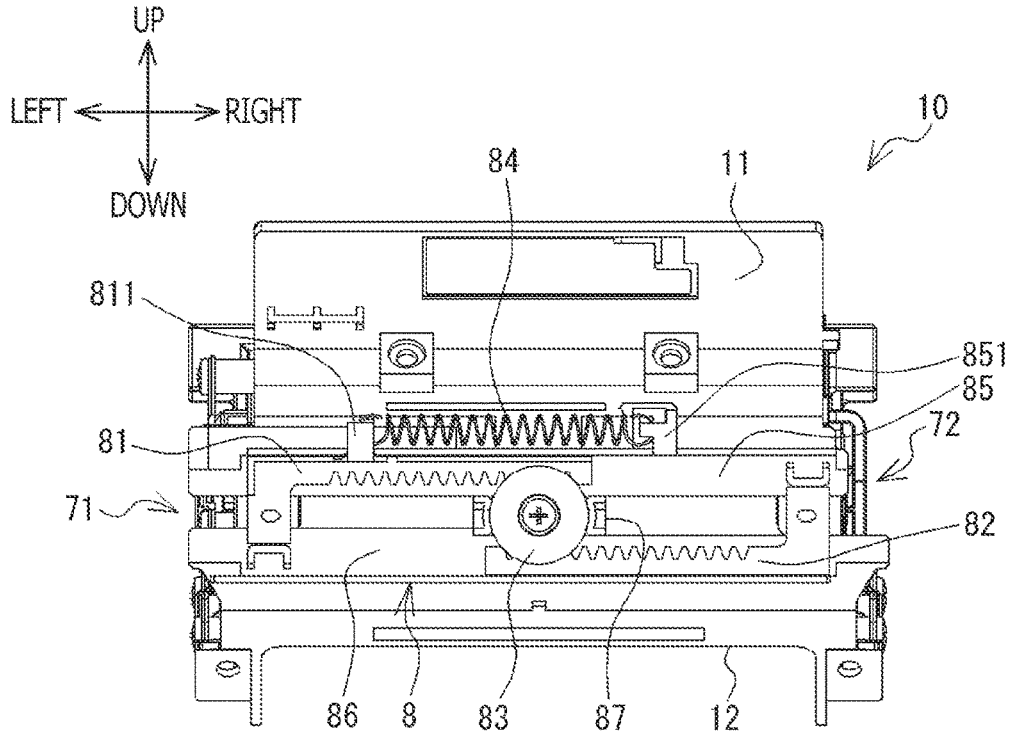
FIG. 5 is a front view of a holder in the illustrative embodiment according to one or more aspects of the present disclosure.

Referring to FIGS. 2, 3, and 5, the holder 10 will be described. As shown in FIG. 2, the holder 10 includes fixed sections 11 and 12, a connector 13, two supporters 71 and 72, a locking member 76, protrusions 91 and 92, and an adjustment mechanism 8 (see FIG. 5). The fixed section 11 extends substantially orthogonally to the front-to-rear direction. The fixed section 11 is fixedly attached to the front wall of the storage section 24. The fixed section 12 extends substantially orthogonally to the vertical direction. The fixed section 12 is fixedly attached to a lower wall of the storage section 24. The connector 13 connects a middle part of a lower end portion of the fixed section 11 in the left-to-right direction with a middle part of a front end portion of the fixed section 12 in the left-to-right direction.

The two supporters 71 and 72 are opposed to each other in the left-to-right direction. The supporter 71 is configured to support the roll 4 from the left. The supporter 72 is configured to support the roll 4 from the right. When the roll 4 is rotatably supported by the two supporters 71 and 72, a width direction (i.e., an axis direction) of the roll 4 is coincident with the left-to-right direction. Each of the supporters 71 and 72 is supported by the adjustment mechanism 8 to be movable along the left-to-right direction. A distance between the two supporters 71 and 72 is adjusted according to a length (i.e., a width) of the roll 4 in the width direction. The two supporters 71 and 72 are formed bilaterally symmetrical to each other in the left-to-right direction. In the following description, the supporter 71 will be described in detail, and the supporter 72 will be simply mentioned.

The supporter 71 includes a side plate 711 and a shaft 712. The side plate 712 is formed in the shape of a round plate perpendicular to the left-to-right direction. The shaft 712 penetrates a center of the side plate 711 in the left-to-right direction. A right end portion of the shaft 712 retractably protrudes rightward from a right surface of the side plate 711. The supporter 72 includes a side plate 721 and a shaft 722. The side plate 721 and the shaft 722 correspond to the side plate 711 and the shaft 712, respectively.

The locking member 76 is disposed on a left surface of the side plate 711. The locking member 76 includes a locking section 761 and a compression spring (not shown). The locking section 761 extends obliquely from an upper rear side toward a lower front side. The locking section 761 is supported by a cover section 713 to be movable along a direction going obliquely from an upper rear side toward a lower front side. The cover section 713 is disposed at a lower front portion of the left surface of the side plate 711. A lower front end of the locking section 761 protrudes obliquely toward a lower front side from a lower front end portion (hereinafter referred to as a "first section 71A") of the supporter 71 and the cover section 713.

The compression spring of the locking member 76 is provided inside the cover section 713. The compression spring of the locking member 76 extends in the same direction as the direction in which the locking section 761 extends. The compression spring of the locking member 76 applies, to the locking section 761, an urging force acting in a direction from an upper rear side to a lower front side.

The protrusion 91 extends from an upper end portion (hereinafter referred to as a "second section 71B") of the supporter 71 toward an upper front side, up to a position near the left lock section 25. The protrusion 92 extends from an upper end portion (hereinafter referred to as a "second section 72B") of the supporter 72 toward an upper front side, up to a position near the right lock section 25. Each of the two protrusions 91 and 92 is formed in a plate shape. Further, the two protrusions 91 and 92 are formed bilaterally symmetrical to each other in the left-to-right direction. In the following description, the protrusion 91 will be described in detail, and the protrusion 92 will be simply mentioned.

The protrusion 91 includes a contact section 911. The contact section 911 protrudes toward an upper front side from a corner positioned at a highest portion of the protrusion 91. The contact section 911 has a rounded distal end. The protrusion 91 has a length T1 (see FIGS. 3 and 6) in the left-to-right direction. The length T1 is shorter than the length T2 of each left engagement piece 42 in the left-to-right direction. Further, the length T1 is longer than the distance T3 between each two of mutually-adjacent left engagement pieces 42 in the left-to-right direction. In the illustrative embodiment, T1=2 mm, T2=3 mm, and T3=0.3 mm, but they are not limited to the above-exemplified lengths. The protrusion 92 includes a contact section 921. The contact section 921 corresponds to the contact section 911.

As shown in FIG. 5, the adjustment mechanism 8 is configured to support at least one of the two supporters 71 and 72 in such a manner that at least one of the supporters 71 and 72 is movable along the left-to-right direction. It is noted that in the illustrative embodiment, the adjustment mechanism 8 supports both of the two supporters 71 and 72 in such a manner that the supporters 71 and 72 are movable along the left-to-right direction. The adjustment mechanism 8 is disposed in front of the roll 4 (see FIG. 2) supported by the supporters 71 and 72. The adjustment mechanism 8 includes racks 81 and 82, a pinion gear 83, a tensile spring 84, and supporting sections 85 to 87.

The supporting section 85 is formed in a plate shape. The supporting section 85 extends substantially downward from a lower end portion of the fixed section 11. The supporting section 86 is formed in a plate shape. The supporting section 86 extends substantially upward from a front end portion of the fixed section 12. The two supporting sections 85 and 86 are opposed to each other in the vertical direction. A spring holder 851 is disposed at a right portion of a front surface of the supporting section 85 relative to a center portion of the front surface in the left-to-right direction. A right end of the tensile spring 84 is hooked on the spring holder 851. The rack 81 is supported by the supporting section 85 to be movable along the left-to-right direction. The rack 82 is supported by the supporting section 86 to be movable along the left-to-right direction.

The racks 81 and 82 are formed substantially in the same shape. The racks 81 and 82 are opposed to each other in the vertical direction. The rack 81 is disposed above the rack 82. Each of the racks 81 and 82 extends along the left-to-right direction. The rack 81 has teeth formed at a lower end portion thereof. The rack 82 has teeth formed at an upper end portion thereof. A left end portion of the rack 81 is connected with a front end portion of the supporter 71. A right end portion of the rack 82 is connected with a front end portion of the supporter 72. A length of each of the racks 81 and 82 in the left-to-right direction is substantially half as long as a length of the holder 10 in the left-to-right direction. A spring holder 811 is disposed substantially at a center of an upper end portion of the rack 81 in the left-to-right direction. A left end of the tensile spring 84 is hooked on the spring holder 811. The tensile spring 84 extends along the left-to-right direction.

The pinion gear 83 is rotatably supported by the supporting section 87. The supporting section 87 is disposed on a front surface of the connector 13 (see FIG. 2). The pinion gear 83 is formed in a round shape. The pinion gear 83 is disposed below the rack 81 and above the rack 82. There are teeth formed around the pinion gear 83. A rotational shaft of the pinion gear 83 extends substantially along the front-to-rear direction. An upper end portion of the teeth of the pinion gear 83 engages with the teeth of the rack 81. A lower end portion of the teeth of the pinion gear 83 engages with the teeth of the rack 82. Along with rotation of the pinion gear 83, each of the racks 81 and 82 moves along the left-to-right direction. Along with the movement of the racks 81 and 82, the two supporters 71 and 72 move along the left-to-right direction.

For instance, when the supporter 71 moves leftward by a particular distance, the supporter 72 moves rightward by the particular distance in conjunction with the movement of the supporter 71, via the rack 81, the pinion gear 83, and the rack 82. Namely, the two supporters 71 and 72 are moved by the racks 81 and 82 and the pinion gear 83 in such directions as to be farther away from each other (i.e., outward in the left-to-right direction). When the supporter 71 comes into contact with a left wall of the storage section 24 (see FIG. 2) from the right, the supporter 71 is restricted from moving leftward. When the supporter 72 comes into contact with a right wall of the storage section 24 from the left, the supporter 72 is restricted from moving rightward.

When the supporter 71 moves rightward by a particular distance, the supporter 72 moves leftward by the particular distance in conjunction with the movement of the supporter 71, via the rack 81, the pinion gear 83, and the rack 82. Namely, the two supporters 71 and 72 are moved by the racks 81 and 82 and the pinion gear 83 in such directions as to be closer to each other (i.e., inward in the left-to-right direction). When a joint portion between the rack 81 and the supporter 71 comes into contact with the supporting section 87 from the left, the supporter 71 is restricted from moving rightward. When a joint portion between the rack 82 and the supporter 72 comes into contact with the supporting section 87 from the right, the supporter 72 is restricted from moving leftward.

The protrusion 91 is movable along the left-to-right direction within the movable range S1 (see FIG. 4), along with movement of the supporter 71 along the left-to-right direction. The protrusion 92 is movable along the left-to-right direction within the movable range S2 (see FIG. 4), along with movement of the supporter 72 along the left-to-right direction. The tensile spring 84 provides an urging force to urge the rack 81 rightward. Namely, the tensile spring 84 urges the supporter 71 in such a direction as to bring the supporters 71 and 72 closer to each other.

As shown in FIG. 3, a plurality of irregularities (i.e., projections and recesses) 852 are provided on a rear surface of the supporting section 85. The plurality of irregularities 852 are arranged at regular intervals in the left-to-right direction. The plurality of irregularities 852 are disposed on a lower front side relative to the locking section 761. When moving obliquely toward a lower front side by the urging force from the compression spring of the locking member 76, the locking section 761 comes into engagement with one of the irregularities 852. In this case, the locking section 761 is restricted from moving along the left-to-right direction. When moving obliquely toward an upper rear side against the urging force from the compression spring of the locking member 76, the locking section 761 disengages from the irregularities 852. In this case, the locking section 761 is movable along the left-to-right direction.

Referring to FIG. 2, an explanation will be provided of a procedure for the user to attach the roll 4 into the printer 1. The user moves the locking section 761 toward an upper rear side against the urging force from the compression spring of the locking member 76, and maintains this state. The locking section 761 disengages from the plurality of irregularities 852 (see FIG. 3), and the two supporters 71 and 72 become movable along the left-to-right direction. The user moves the two supporters 71 and 72 in such directions as to separate the supporters 71 and 72 farther away from each other (i.e., outward in the left-to-right direction). The user places the roll 4 (see FIG. 3) between the two supporters 71 and 72. The user moves the two supporters 71 and 72 in such directions as to bring the supporters 71 and 72 closer to each other (i.e., inward in the left-to-right direction) until a distance between the side plates 711 and 721 becomes as long as the width of the roll 4.

The user disengages his (her) hand from the locking member 76. The locking section 761 moves obliquely toward a lower front side by the urging force from the compression spring of the locking member 76, and comes into engagement with one of the irregularities 852. The locking section 761 locks the first section 71A and a lower front end portion (hereinafter referred to as a "first section 72A") of the supporter 72 unmovable in their respective positions to which the first sections 71A and 72A are moved by the adjustment mechanism 8 (see FIG. 5). Thereby, each of the supporters 71 and 72 is restricted from moving along the left-to-right direction. The shafts 712 and 722 are inserted into the core body of the roll 4. The side plates 711 and 721 come into contact with left and right side surfaces of the roll 4, respectively. Thus, the supporters 71 and 72 rotatably support the roll 4 from both sides in the left-to-right direction. The roll 4 is held by the holder 10. Thus, the printer 1 is brought into a printable state in which the printer 1 is allowed to perform printing on the thermosensitive label wound in the shape of the roll 4.

Referring to FIG. 3, a relationship between the protrusion 91 and the left engagement pieces 42 will be described. In response to the cover 3 swinging from the open position toward the closed position, the engagement section 40 comes closer to the protrusion 91 obliquely from an upper rear side. The contact section 911 of the protrusion 91 comes into contact with at least one of the left engagement pieces 42 from beneath. Thereby, the at least one of the left engagement pieces 42 is elastically deformed upward. Namely, when the cover 3 is in the closed position, the protrusion 91 engages with the at least one of the left engagement pieces 42 from beneath. In the illustrative embodiment, the left engagement pieces 42 are provided over the range D1 that includes the movable range S1 of the protrusion 91. Hence, wherever the supporter 71 is moved by the adjustment mechanism 8, the protrusion 91 is allowed to certainly engage with at least one of the left engagement pieces 42. Hereinafter, at least one of the left engagement pieces 42 with which the protrusion 91 engages when the cover 3 is in the closed position may be referred to as a "first engagement piece 421." When the cover 3 is in the closed position, the first engagement piece 421 is maintained elastically deformed upward.

In response to the cover 3 swinging from the closed position toward the open position, the engagement section 40 is separated away from the protrusion 91 obliquely toward an upper rear side. Thus, the protrusion 91 disengages from the first engagement piece 421. The first engagement piece 421 restores to an original state (in which the first engagement piece 421 is not deformed) from the elastically deformed state. It is noted that a relationship between the protrusion 92 and the right engagement pieces 43 is substantially the same as the aforementioned relationship between the protrusion 91 and the left engagement pieces 42. Therefore, an explanation of the relationship between the protrusion 92 and the right engagement pieces 43 will be omitted.

Figure 6:
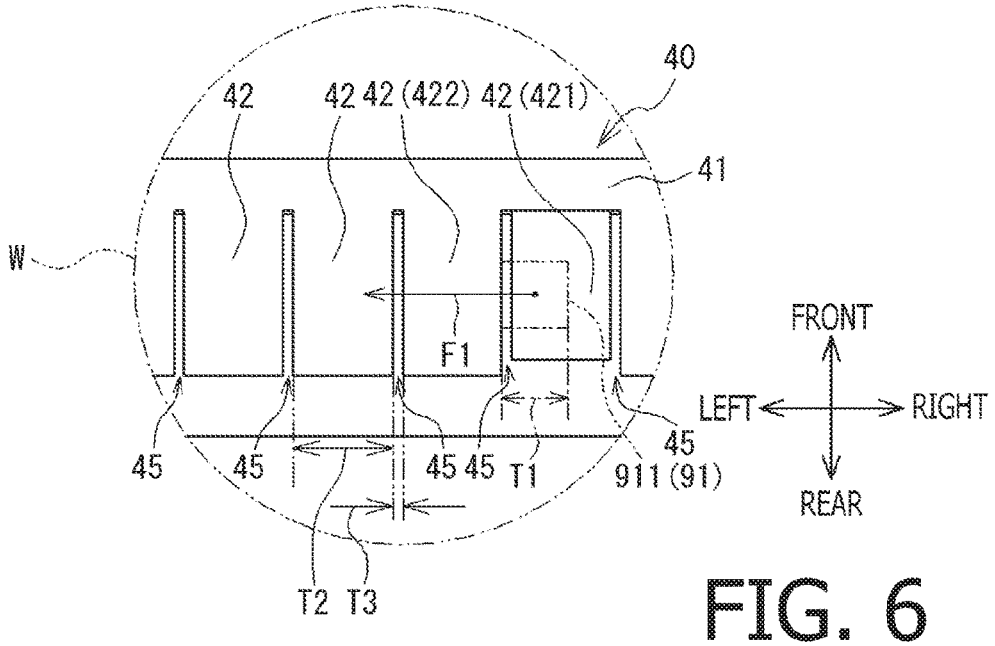
FIG. 6 is an enlarged view of a region W shown in FIG. 4, when a first external force is applied to a specific supporter, in the illustrative embodiment according to one or more aspects of the present disclosure.

As described above, the first section 71A of the supporter 71 is locked by the locking section 761. Further, as shown in FIG. 6, when the cover 3 is in the closed position, the protrusion 91 engages with at least one of the left engagement pieces 42 (i.e., the first engagement piece 421) from beneath, and the first engagement piece 421 is maintained elastically deformed. Thereby, the protrusion 91, which protrudes from the second section 71B, is held by two left engagement pieces 42 that are respectively adjacent to both ends of the first engagement piece 421 in the left-to-right direction. For instance, due to an impact caused when the printer 1 falls from a first height, a first external force F1 might be applied leftward to the supporter 71. In this case, due to flection of the supporter 71, the protrusion 91 comes in contact with a left engagement piece 42 (hereinafter referred to as a "second engagement piece 422") adjacent to a left end of the first engagement piece 421, from the right. Thereby, the protrusion 91 is restricted from moving leftward. Further, the first section 71A is disposed at a lower portion of the supporter 71. The second section 71B is disposed at an upper portion of the supporter 71. Thus, the supporter 71 is held by the two points that are positionally different from each other. Hence, when the first external force F1 is applied leftward to the supporter 71, the supporter 71 is restricted from moving leftward from the position to which the supporter 71 has been moved by the adjustment mechanism 8, and the first external force F1 applied to the supporter 71 is buffered. Accordingly, the printer 1 is enabled to prevent the supporter 71 from being damaged even when the first external force F1 is applied leftward to the supporter 71. Likewise, the printer 1 is enabled to prevent the supporter 71 from being damaged even when the first external force F1 is applied rightward to the supporter 72. Thus, the printer 1 is enabled to prevent the supporters 71 and 72 from being damaged even when the printer 1 receives an impact caused due to the printer 1 falling, e.g., from the first height.

Figure 7:
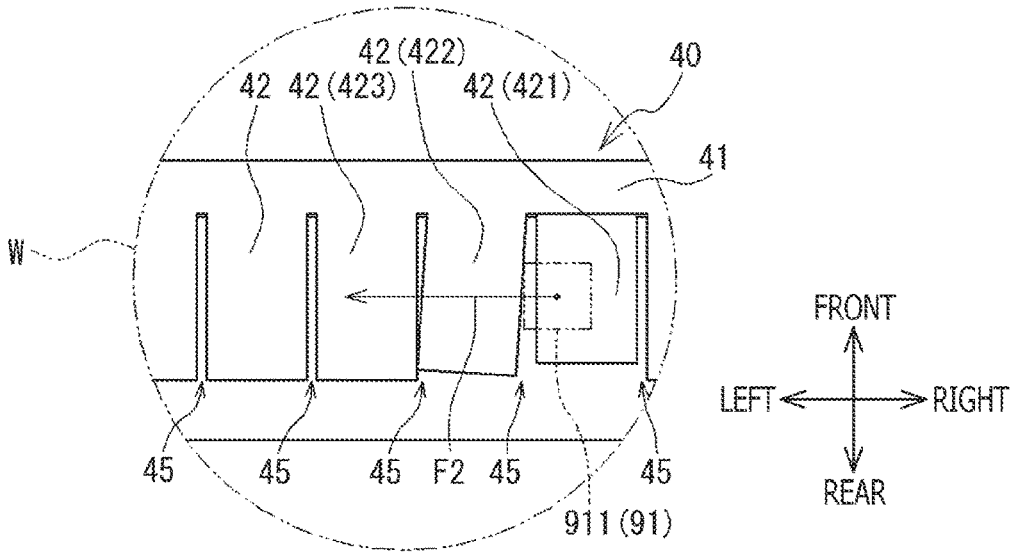
FIG. 7 is an enlarged view of the region W shown in FIG. 4, when a second external force is applied to the specific supporter, in the illustrative embodiment according to one or more aspects of the present disclosure.

As shown in FIG. 7, for instance, due to an impact caused when the printer 1 falls from a second height higher than the first height, a second external force F2 greater than the first external force F1 (see FIG. 6) might be applied leftward to the supporter 71. In this case, each of the left engagement pieces 42 is elastically deformable in any direction along the left-to-right direction. Hence, the second engagement piece 422 is pressed by the protrusion 91 and elastically deformed leftward. When the second engagement piece 422 elastically deformed leftward comes into contact with a left engagement piece 42 (hereinafter referred to as a "third engagement piece 423") adjacent to a left end of the second engagement piece 422, from the right, the supporter 72 is restricted from moving leftward, and the second external force F2 is buffered. Accordingly, the printer 1 is enabled to prevent the supporter 71 from being damaged even when the second external force F2 greater than the first external force F1 is applied leftward to the supporter 71. Likewise, the printer 1 is enabled to prevent the supporter 71 from being damaged even when the second external force F2 is applied rightward to the supporter 71. Thus, the printer 1 is enabled to prevent the supporters 71 and 72 from being damaged even when the printer 1 receives an impact caused due to the printer 1 falling, e.g., from the second height higher than the first height.

Figure 8:
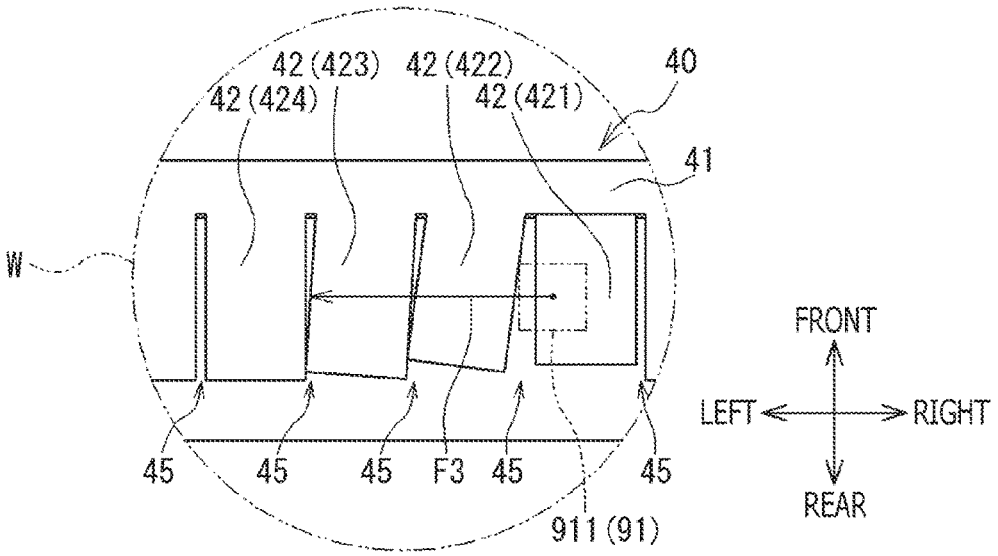
FIG. 8 is an enlarged view of the region W shown in FIG. 4, when a third external force is applied to the specific supporter, in the illustrative embodiment according to one or more aspects of the present disclosure.

As shown in FIG. 8, for instance, due to an impact caused when the printer 1 falls from a third height higher than the second height, a third external force F3 greater than the second external force F2 (see FIG. 7) might be applied leftward to the supporter 71. In this case, the third engagement piece 423 is pressed by the second engagement piece 422 elastically deformed leftward, and is elastically deformed leftward. When the third engagement piece 423 elastically deformed leftward comes into contact with a left engagement piece 42 (hereinafter referred to as a "fourth engagement piece 424") adjacent to a left end of the third engagement piece 423, from the right, the supporter 72 is restricted from moving leftward, and the third external force F3 is buffered. Accordingly, the printer 1 is enabled to prevent the supporter 71 from being damaged even when the third external force F3 greater than the second external force F2 is applied leftward to the supporter 71. Likewise, the printer 1 is enabled to prevent the supporter 71 from being damaged even when the third external force F3 is applied rightward to the supporter 71. Thus, the printer 1 is enabled to prevent the supporters 71 and 72 from being damaged even when the printer 1 receives an impact caused due to the printer 1 falling, e.g., from the third height higher than the second height.

The length T1 of the protrusion 91 in the left-to-right direction is longer than the distance T3 between each two of mutually-adjacent left engagement pieces 42. Therefore, when the cover 3 is in the closed position, the protrusion 91 is allowed to certainly engage with at least one of the left engagement pieces 42 without entering the slit 45 between mutually-adjacent left engagement pieces 42. Likewise, the protrusion 91 is allowed to certainly engage with at least one of the right engagement pieces 43 without entering the slit 46 between mutually-adjacent right engagement pieces 43. Further, the length T1 of the protrusion 91 in the left-to-right direction is shorter than the length T2 of each left engagement piece 42 in the left-to-right direction. Hence, a possibility that the protrusion 91 engages with two or more left engagement pieces 42 is lower than when the length T1 is equal to or longer than the length T2. Consequently, the number of left engagement pieces 42 that are repeatedly deformed when the cover 3 is repeatedly opened and closed a particular number of times is smaller than when the length T1 is equal to or longer than the length T2. Accordingly, the printer 1 is enabled to prevent the left engagement pieces 42 from being deteriorated due to repeated elastic deformation of the left engagement pieces 42. Likewise, the printer 1 is enabled to prevent the right engagement pieces 43 from being deteriorated due to repeated elastic deformation of the right engagement pieces 43.

In the illustrative embodiment, the length T2 of every left engagement piece 42 in the left-to-right direction is the same, and the distance (gap) T3 between every two of mutually-adjacent left engagement pieces 42 is uniform. Therefore, wherever the supporter 71 is moved by the adjustment mechanism 8, the protrusion 91 is allowed to certainly engage with at least one of the left engagement pieces 42. Likewise, wherever the supporter 72 is moved by the adjustment mechanism 8, the protrusion 92 is allowed to certainly engage with at least one of the left engagement pieces 43.

Hereinabove, the illustrative embodiment according to aspects of the present disclosure has been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only an exemplary illustrative embodiment of the present disclosure and but a few examples of its versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

<Modifications>

Figure 9:
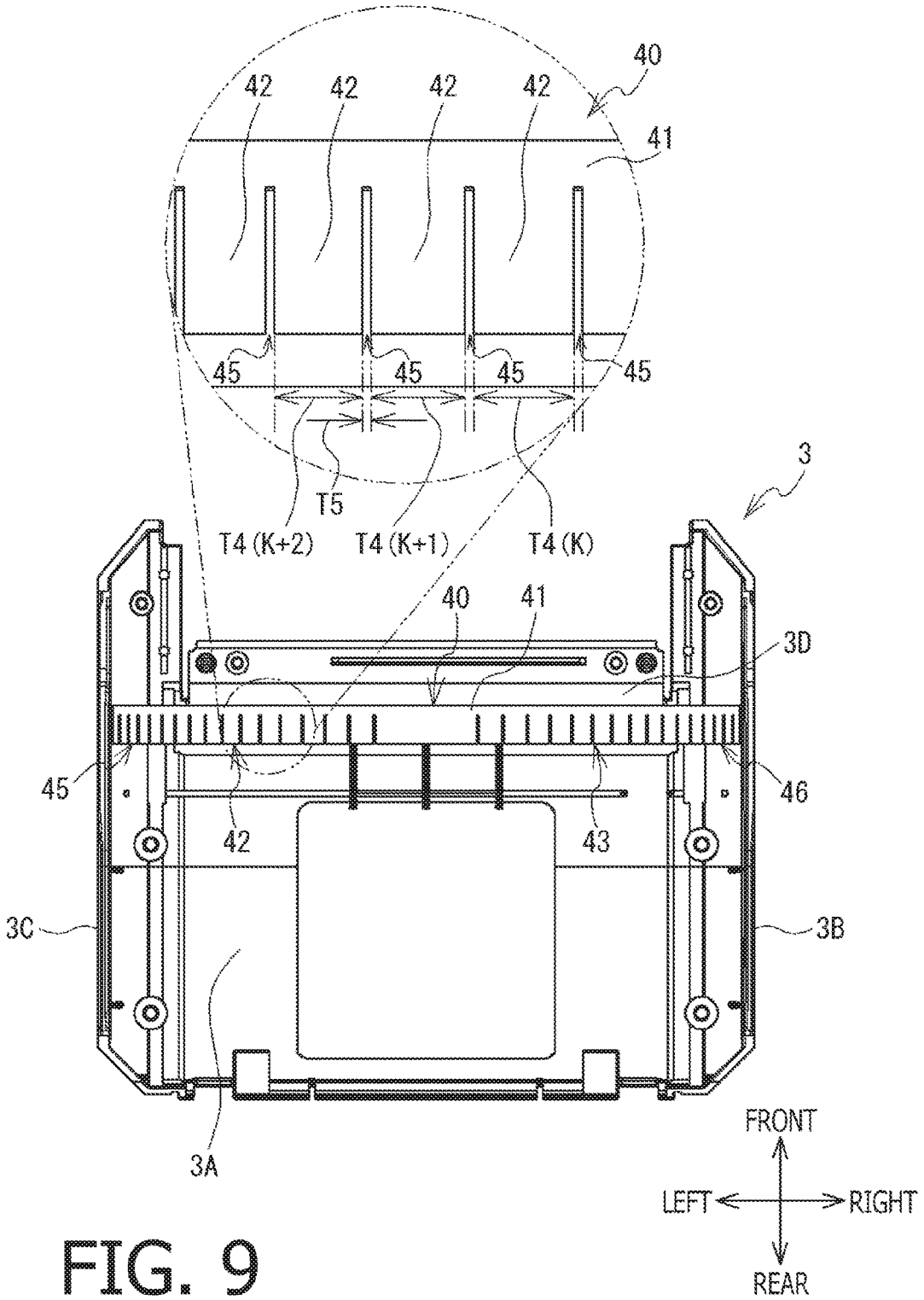
FIG. 9 is a bottom view of a cover in a first modification according to one or more aspects of the present disclosure.

A first modification will be described with reference to FIG. 9. In the following description, different points from the aforementioned illustrative embodiment will be mainly explained. Elements having the same functions as exemplified in the illustrative embodiment will be provided with the same reference characters, and explanations of the elements will be omitted. The first modification is different from the illustrative embodiment only in that a length T4 of each left engagement piece 42 in the left-to-right direction is not uniform. Specifically, the length T4 of each left engagement piece 42 in the left-to-right direction becomes gradually shorter outward from the center of the engagement section 40 in the left-to-right direction. For instance, when the lengths T4 of the left engagement pieces 42 in the left-to-right direction are provided with reference characters T4 (1), T4 (2), T4 (3), . . . , respectively in an order leftward from the center of the engagement section 40 in the left-to-right direction, a relationship "T4 (K)>T4 (K+1)" is satisfied (K is a natural number). Every slit 45 has the same outer shape and the same size. Namely, the width of each slit 45 in the left-to-right direction is uniform. In other words, a distance (gap) T5 between every two of mutually-adjacent left engagement pieces 42 in the left-to-right direction is uniform. It is noted that the engagement section 40 is formed bilaterally symmetric in the left-to-right direction. Therefore, the right engagement pieces 43 and the slits 46 are formed and arranged in the same manner as exemplified for the left engagement pieces 42 and the slits 45.

For instance, even though the roll 4 has a uniform outer diameter, the wider the roll 4 is, the heavier the roll 4 is. As the weight of the roll 4 increases, an external force increases that is applied to each of the supporters 71 and 72 due to an impact caused when the printer 1 falls. In the first modification, as the position of the supporter 71 is shifted leftward, the length T4 of a specific one of the left engagement pieces 42 corresponding to the position of the supporter 71 becomes gradually shorter. Therefore, when an external force is applied to the supporter 71, the printer 1 is enabled to make the flection of the supporter 71 smaller as the supporter 71 is positioned farther outside in the left-to-right direction. Likewise, when an external force is applied to the supporter 72, the printer 1 is enabled to make the flection of the supporter 72 smaller as the supporter 72 is positioned farther outside in the left-to-right direction. In other words, the printer 1 is enabled to buffer the impact in accordance with the width of the roll 4. Thus, the printer 1 is enabled to prevent the supporters 71 and 72 from being damaged due to an impact caused when the printer 1 falls.

Figure 10:
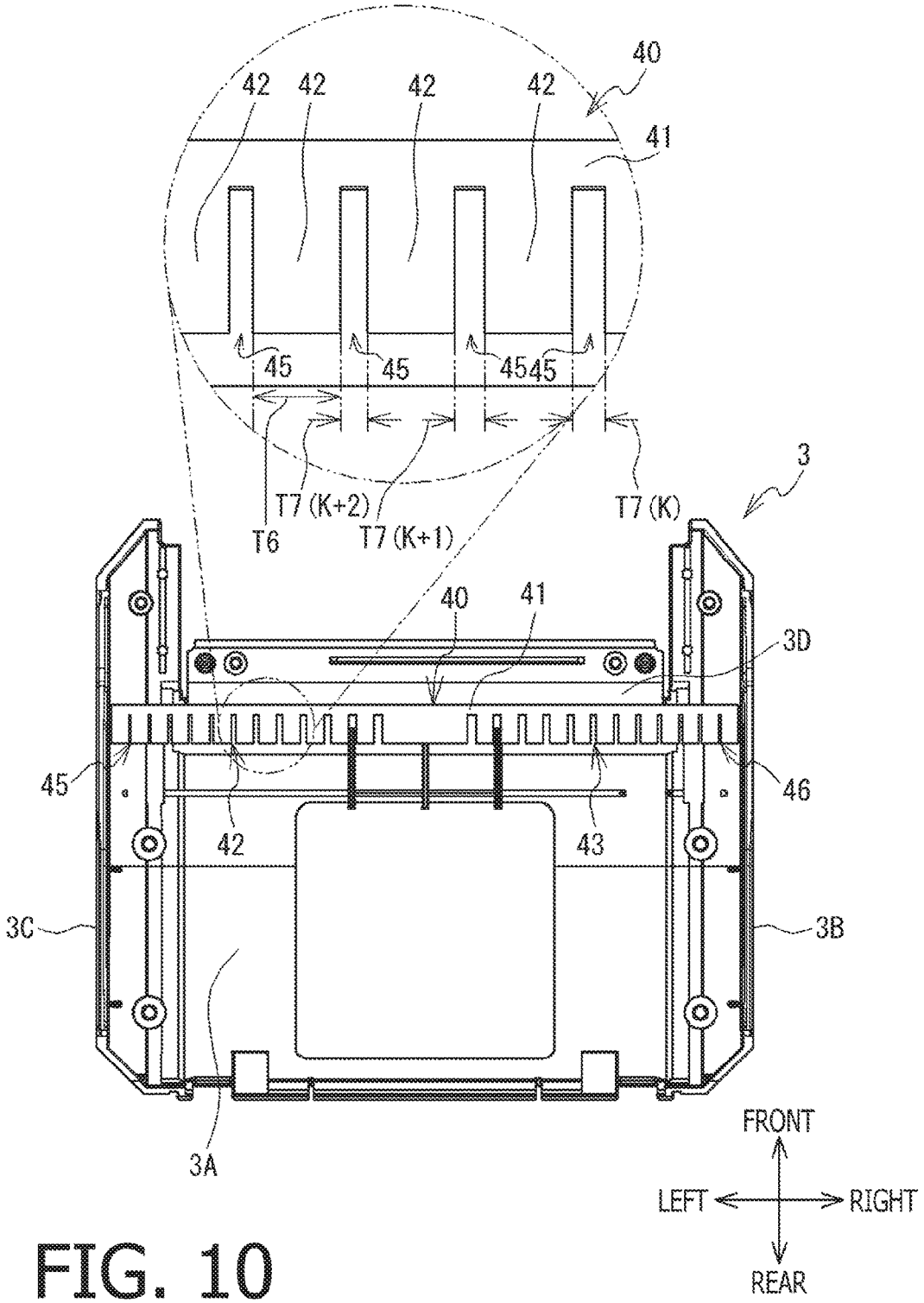
FIG. 10 is a bottom view of a cover in a second modification according to one or more aspects of the present disclosure.

A second modification will be described with reference to FIG. 10. The second modification is different from the aforementioned illustrative embodiment only in that a distance (gap) T7 between each two of mutually-adjacent left engagement pieces 42 in the left-to-right direction is not uniform. Specifically, every left engagement piece 42 has the same outer shape and the same size. Namely, a length T6 of each left engagement piece 42 in the left-to-right direction is uniform. A width of each slit 45 in the left-to-right direction becomes gradually shorter outward from the center of the engagement section 40 in the left-to-right direction. In other words, the distance T7 between each two of mutually-adjacent left engagement pieces 42 becomes gradually shorter outward from the center of the engagement section 40 in the left-to-right direction. For instance, the distance T7 between each two of mutually-adjacent left engagement pieces 42 is provided with reference characters T7 (1), T7 (2), T7 (3), . . . , in an order leftward from the center of the engagement section 40 in the left-to-right direction, a relationship "T7 (K)>T7 (K+1)" is satisfied (K is a natural number). It is noted that the engagement section 40 is formed bilaterally symmetric in the left-to-right direction. Therefore, the right engagement pieces 43 and the slits 46 are formed and arranged in the same manner as exemplified for the left engagement pieces 42 and the slits 45.

In the second modification, as the position of the supporter 71 is shifted leftward, the distance T7 between a specific couple of mutually-adjacent left engagement pieces 42 corresponding to the position of the supporter 71 becomes gradually shorter. Therefore, when an external force is applied to the supporter 71, the printer 1 is enabled to make the flection of the supporter 71 smaller as the supporter 71 is positioned farther outside in the left-to-right direction. Likewise, when an external force is applied to the supporter 72, the printer 1 is enabled to make the flection of the supporter 72 smaller as the supporter 72 is positioned farther outside in the left-to-right direction. In other words, the printer 1 is enabled to buffer the impact in accordance with the width of the roll 4. Thus, the printer 1 is enabled to prevent the supporters 71 and 72 from being damaged due to an impact caused when the printer 1 falls.

In the aforementioned illustrative embodiment, each of the left engagement pieces 42 and the right engagement pieces 43 is formed in a rectangular shape in the plane view. Nonetheless, each of the left engagement pieces 42 and the right engagement pieces 43 may be formed in a triangle shape or a trapezoidal shape in the plane view. Further, in the aforementioned illustrative embodiment, the left engagement pieces 42 and the right engagement pieces 43 have the same outer shape and the same size. However, the left engagement pieces 42 and the right engagement pieces 43 may have different outer shapes and/or different sizes, respectively.

In the aforementioned illustrative embodiment, the two supporters 71 and 72 are supported by the adjustment mechanism 8 to be movable along the left-to-right direction. Nonetheless, only one of the supporters 71 and 72 may be supported by the adjustment mechanism 8 to be movable along the left-to-right direction. Namely, the other one of the supporters 71 and 72 may be positionally fixed in the left-to-right direction. Even in this case, in the same manner as exemplified in the aforementioned illustrative embodiment, the printer 1 is enabled to prevent a specific one of the supporters 71 and 72 that is movably supported by the adjustment mechanism 8 from being damaged due to an impact caused when the printer 1 falls. Hereinafter, a specific one of the supporters 71 and 72 that is movably supported by the adjustment mechanism 8 may be referred to as a "specific supporter." In this case, the engagement section 40 may only have the engagement pieces for the specific supporter, among the left engagement pieces 42 and the right engagement pieces 43 provided in the aforementioned illustrative embodiment. A length of each engagement piece in the left-to-right direction may become gradually shorter in a direction toward the specific supporter from the other supporter (i.e., the supporter positionally fixed in the left-to-right direction). A distance (gap) between each two of mutually-adjacent engagement pieces may become gradually shorter in the direction toward the specific supporter from the other supporter.

In the aforementioned illustrative embodiment, the two supporters 71 and 72 are configured to rotatably support the roll 4 from both sides in the left-to-right direction by the shafts 712 and 722 inserted into the core body of the roll 4. Instead of this configuration, the two supporters 71 and 72 may be configured to rotatably support the roll 4 from both sides in the left-to-right direction by the two side plates 711 and 721, without using any of the shafts 712 and 722. In this case, for instance, the roller 4 may be placed on the lower wall of the storage section 24.

In the aforementioned illustrative embodiment, the engagement section 40 is formed integrally with the cover 3. Nonetheless, the engagement section 40 may be formed as a separate member from the cover 3. Namely, the separate engagement section 40 may be fixedly attached to the cover 3 by one or more fixing members such as screws. The engagement section 40 may be formed separated into a part having the left engagement pieces 42 and a part having the right engagement pieces 43.

In the aforementioned illustrative embodiment, the first section 71A is a lower front end portion of the supporter 71, and the first section 72A is a lower front end portion of the supporter 72. Further, the second section 71B is an upper end portion of the supporter 71, and the second section 72B is an upper end portion of the supporter 72. Nonetheless, the first section 71A may be a lower end portion of the supporter 71, and the first section 72A may be a lower end portion of the supporter 72. As two portions (e.g., the first section 71A and the second section 71B) of the supporter 71 that restrict movement of the supporter 71 in the left-to-right direction are disposed farther away from each other (e.g., when the portions are disposed at both ends on a diagonal of the supporter 71, respectively), the printer 1 is allowed to more certainly restrict movement of the supporter 71 by the two points even though the printer 1 receives an impact caused when the printer 1 falls. Likewise, as two portions (e.g., the first section 72A and the second section 72B) of the supporter 72 that restrict movement of the supporter 72 in the left-to-right direction are disposed farther away from each other (e.g., when the portions are disposed at both ends on a diagonal of the supporter 72, respectively), the printer 1 is allowed to more certainly restrict movement of the supporter 72 by the two points even though the printer 1 receives an impact caused when the printer 1 falls. In this case, the printer 1 is allowed to effectively prevent the two supporters 71 and 72 from being damaged due to an impact caused when the printer 1 falls.

With respect to associations of elements exemplified in the aforementioned illustrative embodiment and modifications with elements to be defined according to aspects of the present disclosure, the roll 4 may be an example of a "roll" according to aspects of the present disclosure. The left-to-right direction of the printer 1 may be an example of a "first direction" according to aspects of the present disclosure. The vertical direction of the printer 1 may be an example of a "second direction" according to aspects of the present disclosure. The upper side of the printer 1 may be an example of a "first side in the second direction" according to aspects of the present disclosure. The lower side of the printer 1 may be an example of a "second side in the second direction" according to aspects of the present disclosure. The storage section 24 may be an example of a "storage section" according to aspects of the present disclosure. The main body 2 may be an example of a "main body" according to aspects of the present disclosure. The cover 3 may be an example of a "cover" according to aspects of the present disclosure. The two supporters 71 and 72 may be an example of "two supporters" according to aspects of the present disclosure. The adjustment mechanism 8 may be an example of an "adjuster" according to aspects of the present disclosure. The first sections 71A and 72A may be examples of a "first section" according to aspects of the present disclosure. The lock section 761 may be an example of a "lock section" according to aspects of the present disclosure. The second sections 71B and 72B may be examples of a "second section" according to aspects of the present disclosure. The protrusions 91 and 92 may be examples of a "protrusion" according to aspects of the present disclosure. The plurality of left engagement pieces 42 may be an example of a "plurality of engagement pieces" according to aspects of the present disclosure. The plurality of right engagement pieces 43 may be an example of the "plurality of engagement pieces" according to aspects of the present disclosure. The engagement section 40 may be an example of an "engagement section" according to aspects of the present disclosure. The first engagement piece 421 may be an example of a "first engagement piece" according to aspects of the present disclosure. The second engagement piece 422 may be an example of a "second engagement piece" according to aspects of the present disclosure. The third engagement piece 423 may be an example of a "third engagement piece" according to aspects of the present disclosure. The fourth engagement piece 424 may be an example of a "fourth engagement piece" according to aspects of the present disclosure.

What is claimed is:

1. A printer comprising:

a main body comprising a storage section configured to accommodate a roll, the roll being a print medium wound in a roll shape, the storage section being open toward a first side in a second direction intersecting a first direction, the first direction being an axis direction of the roll, the first side being a particular one of both sides of the printer in the second direction;

a cover openable and closable relative to the storage section, the cover being configured to, when closed, cover the storage section from the first side in the second direction;

two supporters disposed at the storage section, the two supporters being configured to support the roll from both sides of the roll in the first direction;

an adjuster configured to support at least a specific supporter of the two supporters in such a manner that the specific supporter is movable along the first direction, and to adjust a distance between the two supporters in the first direction in accordance with movement of the specific supporter along the first direction;

a locking section configured to lock a first section in a position to which the first section is placed when the specific supporter is moved via the adjuster, the first section being a second-side portion of the specific supporter in the second direction, the second side being opposite to the first side in the second direction;

a protrusion that protrudes toward the first side in the second direction from a second section, the second section being a first-side portion of the specific supporter in the second direction; and an engagement section disposed at the cover, the engagement section comprising a plurality of engagement pieces arranged with a gap between each two of mutually-adjacent engagement pieces in the first direction, each engagement piece being elastically deformable toward the first side in the second direction, wherein the protrusion is configured to, when the cover is closed, engage with at least a first engagement piece of the engagement pieces from the second side in the second direction, the first engagement piece being maintained elastically deformed toward the first side in the second direction, and wherein the protrusion is further configured to, when a first external force toward a third side in the first direction is applied to the specific supporter, come into contact with a second engagement piece from a fourth side in the first direction due to flection of the specific supporter, the protrusion being restricted from moving toward the third side in the first direction, due to the contact with the second engagement piece, the third side being a particular one of both sides of the printer in the first direction, the fourth side being opposite to the third side in the first direction, the second engagement piece being a particular one of the engagement pieces that is adjacent to a third-side end of the first engagement piece in the first direction.

2. The printer according to claim 1, wherein each engagement piece is elastically deformable along the first direction, and wherein when a second external force greater than the first external force is applied toward the third side in the first direction, to the specific supporter, the second engagement piece is pressed by the protrusion and elastically deformed toward the third side in the first direction, and comes into contact with a third engagement piece from the fourth side in the first direction, the protrusion being restricted from moving toward the third side in the first direction, the third engagement piece being a particular one of the engagement pieces that is adjacent to a third-side end of the second engagement piece in the first direction.

3. The printer according to claim 2, wherein when a third external force greater than the second external force is applied toward the third side in the first direction, to the specific supporter, the third engagement piece is pressed by the second engagement piece elastically deformed toward the third side in the first direction, and is elastically deformed toward the third side in the first direction, and comes into contact with a fourth engagement piece from the fourth side in the first direction, the protrusion being restricted from moving toward the third side in the first direction, the fourth engagement piece being a particular one of the engagement pieces that is adjacent to a third-side end of the third engagement piece in the first direction.

4. The printer according to claim 1, wherein a length of the protrusion in the first direction is shorter than a length of each engagement piece in the first direction and longer than the gap between each two of mutually-adjacent engagement pieces in the first direction.

5. The printer according to claim 4, wherein the length of each engagement piece in the first direction is uniform, and wherein the gap between each two of mutually-adjacent engagement pieces in the first direction is uniform.

6. The printer according to claim 4, wherein the gap between each two of mutually-adjacent engagement pieces in the first direction is uniform, wherein when the adjuster movably supports both of the two supporters, the length of each engagement piece in the first direction becomes gradually shorter outward from a center of the engagement section in the first direction, and wherein when the adjuster movably supports the specific supporter of the two supporters, the length of each engagement piece in the first direction becomes gradually shorter in a direction toward the specific supporter from the other supporter.

7. The printer according to claim 4, wherein the length of each engagement piece in the first direction is uniform, wherein the gap between each two of mutually-adjacent engagement pieces in the first direction is uniform, wherein when the adjuster movably supports both of the two supporters, the gap between each two of mutually-adjacent engagement pieces in the first direction becomes gradually shorter outward from a center of the engagement section in the first direction, and wherein when the adjuster movably supports the specific supporter of the two supporters, the gap between each two of mutually-adjacent engagement pieces in the first direction becomes gradually shorter in a direction toward the specific supporter from the other supporter.

* * * * *